US008398201B2

(12) United States Patent
Horiba et al.

(10) Patent No.: US 8,398,201 B2
(45) Date of Patent: Mar. 19, 2013

(54) RECORDING APPARATUS AND HUMIDIFICATION DEVICE

(75) Inventors: Takashi Horiba, Tokyo (JP); Yuji Kanome, Yokohama (JP); Hikaru Watanabe, Yokohama (JP); Eiichiro Tsuda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 334 days.

(21) Appl. No.: 12/945,456

(22) Filed: Nov. 12, 2010

(65) Prior Publication Data

US 2011/0273505 A1 Nov. 10, 2011

(30) Foreign Application Priority Data

May 6, 2010 (JP) ..... 2010-106714

(51) Int. Cl.
*B41J 29/38* (2006.01)

(52) U.S. Cl. ..... 347/17; 347/25

(58) Field of Classification Search ..... 347/7, 19–22, 347/25, 29, 102; 261/91, 92
See application file for complete search history.

(56) References Cited

U.S. PATENT DOCUMENTS

2008/0018679 A1* 1/2008 Kojima ..... 347/9

FOREIGN PATENT DOCUMENTS

JP 2000255053 A * 9/2000
JP 2005-44021 A 2/2006

* cited by examiner

*Primary Examiner* — Julian Huffman
*Assistant Examiner* — Sharon A Polk
(74) *Attorney, Agent, or Firm* — Canon U.S.A., Inc. IP Division

(57) ABSTRACT

A humidification unit has a structure in which a first humidification chamber and a second humidification chamber are connected in series. Humidified gas produced in the humidification unit and having a high humidity is supplied to a space where nozzles of a recording head are exposed and produces a flow current.

19 Claims, 7 Drawing Sheets

RECORDING APPARATUS AND HUMIDIFICATION DEVICE

BACKGROUND OF THE INVENTION

1. Field of the Invention

The present invention relates to a recording apparatus having an inkjet recording head.

2. Description of the Related Art

Japanese Patent Laid-Open No. 2006-44021 discloses a printer including a plurality of inkjet recording heads arranged along a sheet conveying direction, in which humidified gas is supplied to an area near ink nozzles so as to prevent drying of the nozzles. By filling the gaps between the recording heads with support members and making the recording heads and the support members coplanar, a continuous narrow gap region having a predetermined length is formed. By supplying highly humidified gas to this gap region, each recording head is moisturized and prevented from drying. A unit that produces humidified gas has a single humidification chamber. For example, an ultrasonic vibrator, a heater, or an evaporation filter is used for generating water vapor.

The recording heads to be humidified face a sheet conveying path. Therefore, openings through which a sheet moves in and out are necessary, and the gap region cannot be an enclosed space. For this reason, in order to perform necessary humidification, humidified gas produced in the humidification unit and supplied to the space is required to have an extremely high humidity, for example, a specific humidity of approximately 0.02019 to approximately 0.02722 [kg/kgDA]. However, a humidification unit having a structure such as that disclosed in Japanese Patent Laid-Open No. 2006-44021 needs to be very large in order to produce humidified gas having the necessary humidity. This increases the size of the entire recording apparatus and power consumption.

In the apparatus of Japanese Patent Laid-Open No. 2006-44021, a sheet is held and conveyed by an attraction belt or an attraction roller, and the reverse side of the sheet is attracted and held by an electrostatic attraction technique or a vacuum attraction technique. Because only the reverse side of the sheet is held, the sheet may be poorly attracted depending on the type and property of the sheet. In particular, in the apparatus of Japanese Patent Laid-Open No. 2006-44021, highly humidified gas is blown to the attraction belt or the attraction roller, and therefore charges dissipate from the attraction surface due to the humidity, and the force that holds the sheet is significantly reduced. Therefore, if the sheet has a high stiffness and is strongly curled, the sheet cannot be completely held just by attracting the reverse side of the sheet, and the sheet is partly out of contact with the attraction belt or the attraction roller. In the part being out of contact with the attraction belt or the attraction roller, the quality of an image recorded thereon is decreased. If the part is significantly away from the attraction belt or the attraction roller, the sheet may be brought into contact with the recording heads. If a vacuum attraction technique is used in order to hold the sheet in the apparatus of Japanese Patent Laid-Open No. 2006-44021, vacuum sucks humidified gas before attracting the sheet, and therefore humidification efficiency is very low.

SUMMARY OF THE INVENTION

In an aspect of the present invention, an apparatus includes a recording unit including an inkjet recording head unit, and a humidification unit for supplying humidified gas to a space where nozzles of the recording head unit are exposed. The humidification unit has a first humidification chamber for producing humidified gas and a second humidification chamber connected to the first humidification chamber. Humidified gas produced in the first humidification chamber is introduced into the second humidification chamber. Further humidified gas is produced in the second humidification chamber. The further humidified gas is supplied from the second humidification chamber to the space.

Further features of the present invention will become apparent from the following description of exemplary embodiments with reference to the attached drawings.

DESCRIPTION OF THE EMBODIMENTS

An embodiment of an inkjet printing apparatus will be described. The printing apparatus of this embodiment is a high-speed line printer using a long continuous sheet (a continuous sheet longer than the length of a print unit (referred to as a page or a unit image) repeated in the conveying direction). This recording apparatus is suitable for the field of printing on a large number of sheets, for example, in a printing shop.

Figure 1:
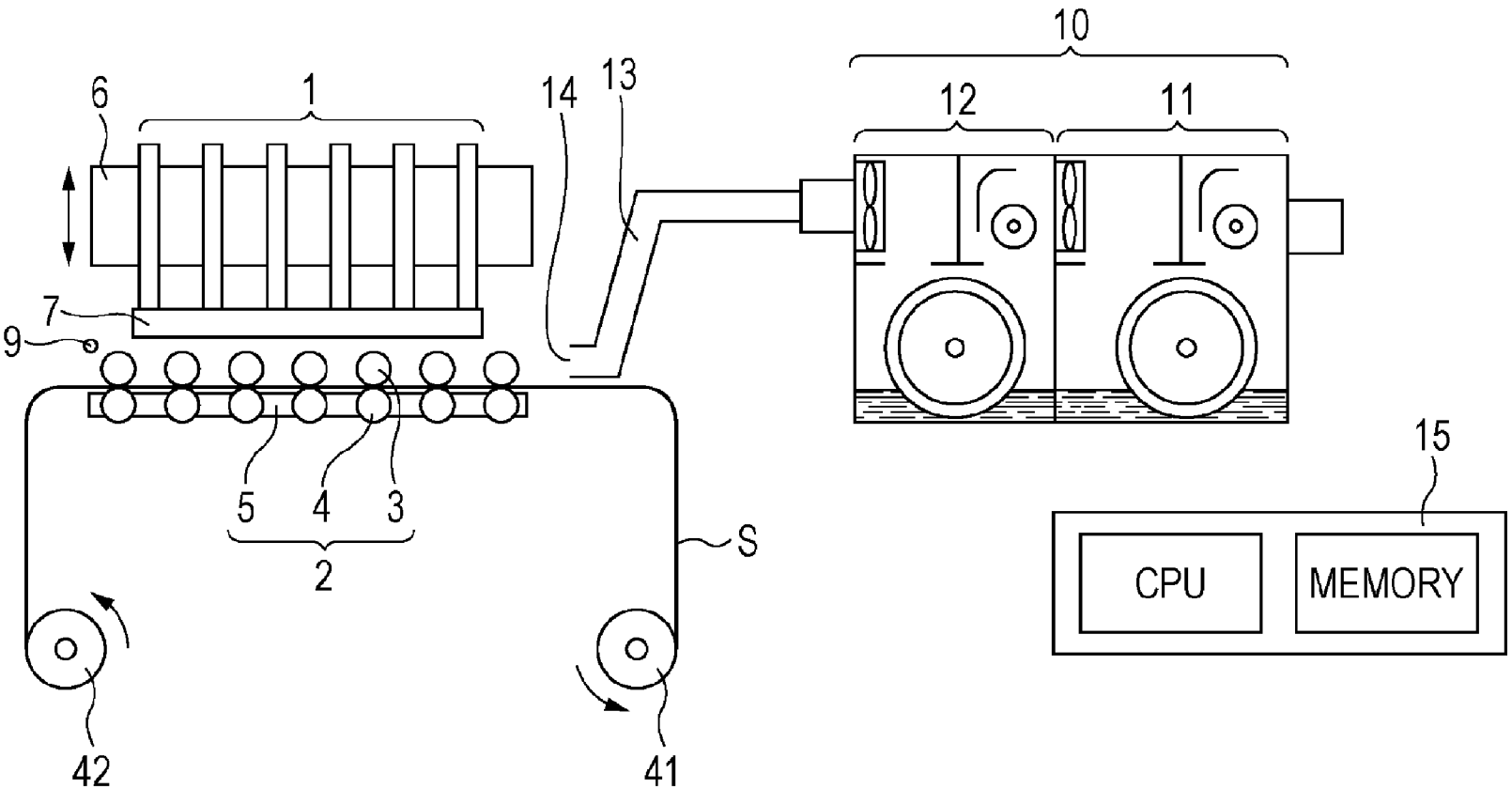
FIG. 1 is a configuration diagram showing a recording apparatus in a standby state.
Figure 2:
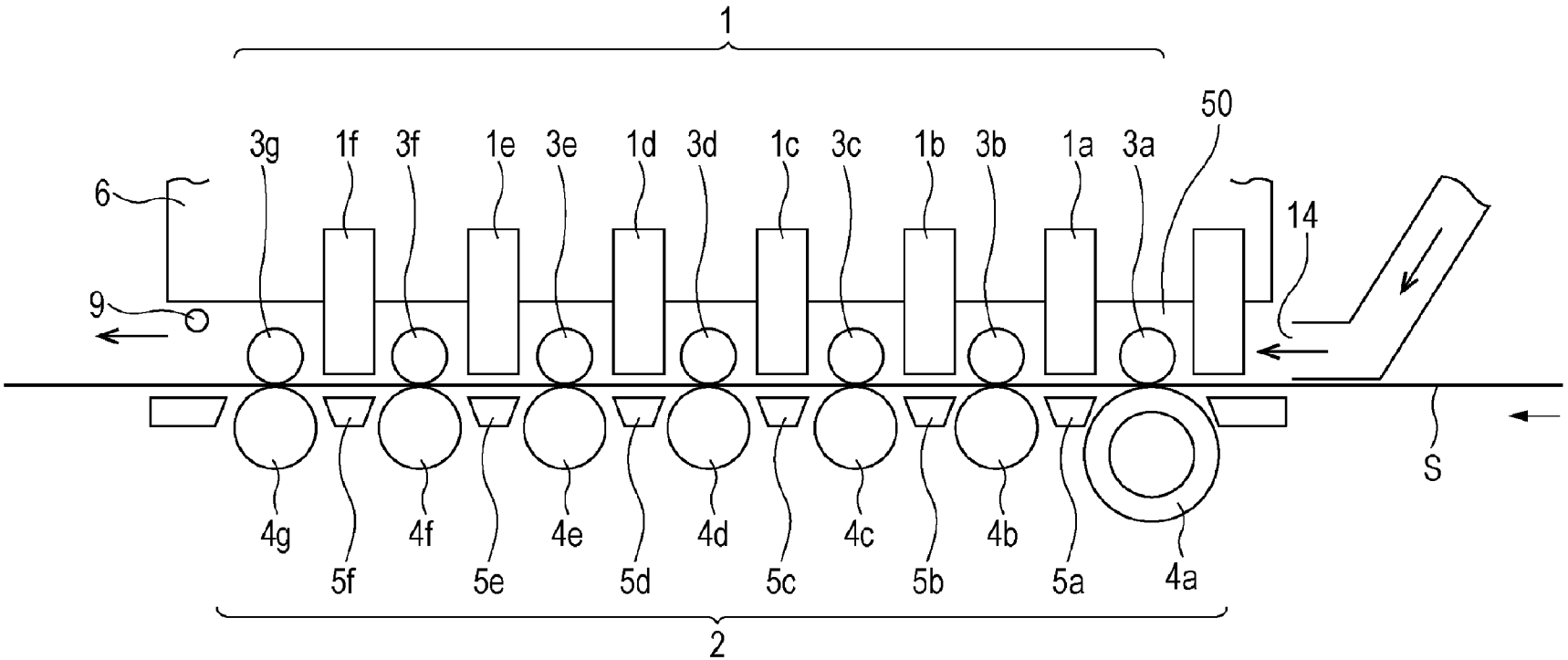
FIG. 2 is an enlarged view of a recording unit and a sheet conveying unit.

FIG. 1 is a configuration diagram showing a recording apparatus of an embodiment in a standby state. FIG. 2 is an enlarged view of a recording unit and a sheet conveying unit. The printing apparatus mainly has a sheet supply unit 41, a recording unit, a sheet conveying unit 2, a sheet take-up unit 42, a humidification unit 10, and a control unit 15. At any position on the sheet conveying path, the side adjacent to the sheet supply unit 41 is referred to as "upstream," and the opposite side is referred to as "downstream."

The sheet supply unit 14 holds and supplies a rolled continuous sheet. Usable sheets are not limited to a rolled sheet. For example, a continuous sheet that is provided with a perforation every unit length and is folded at the perforations into a stack may be loaded in the sheet supply unit 41. Not only a continuous sheet but also cut sheets may be used. The sheet take-up unit 42 takes up the continuous sheet on which images are recorded.

The recording unit has a plurality of recording head units 1 arranged along a direction in which the sheet is conveyed. The recording head units 1 each include a line-type recording head in which a line of inkjet ink nozzles is formed so as to cover the maximum recording width of sheets used with this apparatus. In this embodiment, six recording head units 1*a* to 1*f* (see FIG. 2) corresponding to six colors of C (cyan), M (magenta), Y (yellow), LC (light cyan), LM (light magenta), and K (black) are arranged in order. The number of colors and the number of recording heads are not limited to six. An inkjet technology using, for example, a heater element, a piezoelectric element, an electrostatic element, or a MEMS element can be used. Respective colors of ink are supplied from ink tanks through ink tubes to the recording heads. The recording head units 1 are not limited to those of this embodiment, and each recording head unit may be a recording head integral with an ink tank.

The plurality of recording head units 1 are integrally held by a head holder 6. The head holder 6 is a plate-like member that has six openings into which the six recording head units 1 are to be inserted. When placed in the openings, the recording head units 1 are held hermetically. Therefore, there is no upward gas leakage, and humidified gas to be described below and ink mist generated from the nozzles during recording are prevented from diffusing above the head holder 6. The head holder 6 has a mechanism (adjustment mechanism) movable in the vertical direction (the direction of arrow in FIG. 1) in order to make variable the gap between the ink nozzles of each recording head unit 1 and the sheet at the recording location.

The sheet conveying unit 2 has seven roller pairs that nip the sheet S from both sides near the recording location. Each roller pair includes an upper pinch roller 3 (first roller) that is driven and a lower driving roller 4 (second roller) that is given driving force. As shown in FIG. 2, the pinch rollers 3 include pinch rollers 3*a* to 3*f* in order from the upstream end to the downstream end, and the driving rollers 4 include driving rollers 4*a* to 4*g* in order from the upstream end to the downstream end. These driving rollers are rotated by the driving force of a driving source. The pinch rollers 3*a* to 3*g* all have the same roller diameter. The driving rollers 4*b* to 4*g* all have the same roller diameter. The most upstream driving roller 4*a* has a roller diameter larger than that of the other driving rollers. The sheet conveying unit further has a platen 5 for supporting the sheet S from below at the recording location. As shown in FIG. 2, the platen 5 is divided into six sections 5*a* to 5*f*. The sections are located between the driving rollers 4*a* to 4*g* and face the six recording head units 1*a* to 1*f*. In other words, the driving rollers 4 are rotatably fitted in the openings of the platen 5. Because the gaps between the driving rollers 4 and the platen 5 are small, the leakage of gas from the gaps is low. At each of the facing positions (recording locations) of the recording head units 1*a* to 1*f*, the sheet S is nipped by the roller pairs on both the upstream and downstream sides and is supported by the platen, and therefore the sheet S is stably conveyed. In particular, when the sheet is introduced, the leading edge of the sheet passes through a plurality of nip positions with a short period, therefore the leading edge of the sheet is prevented from curling, and the sheet is stably introduced.

A nozzle cap 7 is a cap for hermetically covering the ink nozzles in order to prevent drying of the nozzles at a standby time when a recording operation is not performed. With the gap extended by the adjustment mechanism, the nozzle cap 7 is inserted under the recording unit and covers the ink nozzles collectively. A humidity sensor 9 detects the humidity of gas at a position near the most downstream recording head unit 1*f*.

The humidification unit 10 is a unit for producing humidified gas (air) and supplying the humidified gas to the space between the recording head units 1 and the sheet. The humidified gas prevents drying of the ink nozzles of the recording head units 1. The humidification unit 10 is a twin humidification device having a first humidification chamber 11 and a second humidification chamber 12 connected in series.

The humidified gas produced in the humidification unit 10 is blown out by a fan through a duct 13 and an outlet 14. The humidified gas is supplied to a narrow space 50 between the recording unit and the sheet conveying unit. The humidified gas blown out from the outlet 14 flows through the space between the most upstream recording head unit 1*a* and the sheet S in the narrow space 50. The humidified gas meanders up and down through the space between the pinch roller 3*b* and the head holder 6, the space between the recording head unit 1*b* and the sheet S, . . . . The narrow space is a space where the ink nozzles of each of the recording head units are exposed. With the humidified gas supplied thereto, the ink nozzles can be moisturized, and clogging due to drying can be prevented.

The control unit 15 is a unit that controls each unit of the printing apparatus. The control unit 15 has a CPU, a memory, a controller having various control sections, an external interface, and an operating unit through which a user performs input and output.

Figure 3:
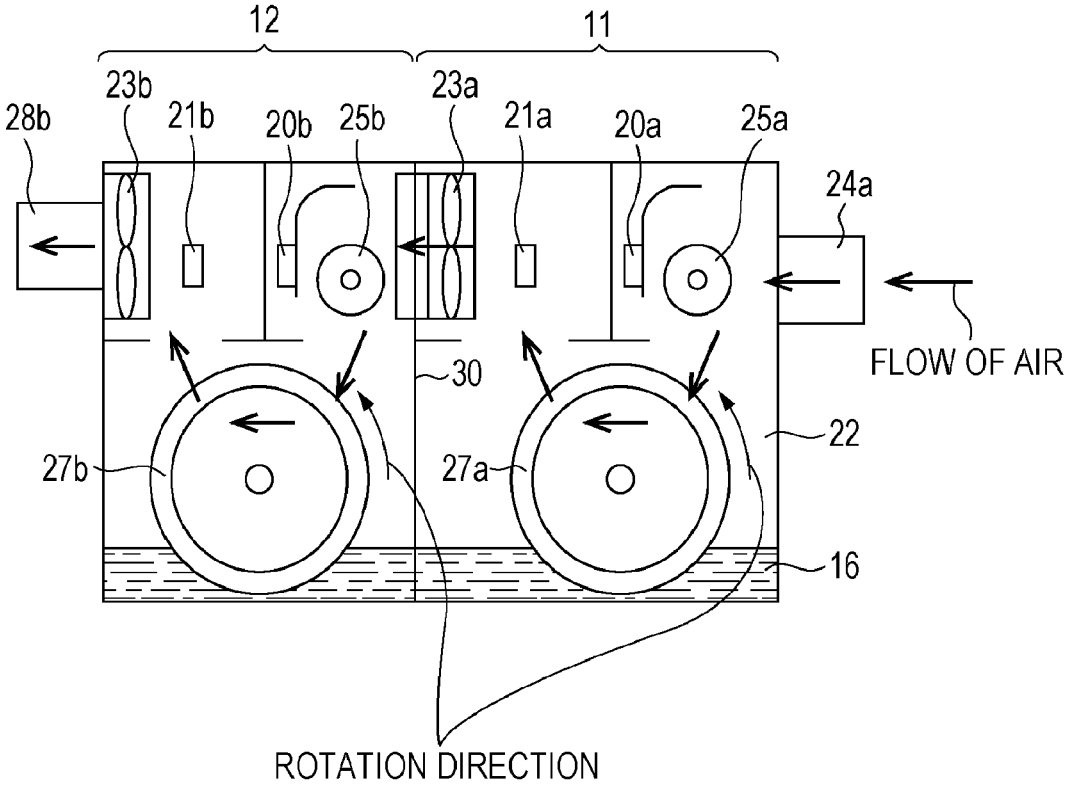
FIG. 3 is a configuration diagram showing the detailed structure of a humidification unit.

FIG. 3 is a configuration diagram showing the detailed structure of the humidification unit 10. The humidification unit 10 has a first humidification chamber 11 and a second humidification chamber 12 connected in series. The first humidification chamber 11 and the second humidification chamber 12 are housed in a case 22 and are integrated. That is to say, the first humidification chamber 11 and the second humidification chamber 12 are separated by a wall 30 and are adjacent to each other in a single case.

The first humidification chamber 11 is provided with an inlet 24*a*, a heater 25*a*, a humidification filter 27*a*, a fan 23*a*, and an outlet 28*a*. The first humidification chamber 11 is further provided with a temperature sensor 20*a* for detecting the temperature in the first humidification chamber 11 and controlling the amount of heat generation of the heater 25*a*, and a temperature humidity sensor 21*a* that measures the humidity Hm of the gas in the first humidification chamber 11. The second humidification chamber 12 is provided with an inlet 24*b* connected to the outlet 28*a*, a heater 25*b*, a humidification filter 27*b*, a fan 23*b*, and an outlet 28*b*. The second humidification chamber 12 is further provided with a temperature sensor 20*b* for detecting the temperature in the second humidification chamber 12 and controlling the amount of heat generation of the heater 25*b*, and a temperature humidity sensor 21*b* that measures the humidity Hm of the gas in the second humidification chamber 12.

At the bottom of the first humidification chamber 11 and the second humidification chamber 12, humidification water 16 for humidification is accumulated. The humidification water 16 is supplied from a tank (not shown). The first humidification chamber 11 and the second humidification chamber 12 are connected at the bottom. The humidification water 16 accumulated at the bottom is shared by the first humidification chamber 11 and the second humidification chamber 12. When the humidification water 16 is accumulated, there is the wall 30 for partition between the first humidification chamber 11 and the second humidification chamber 12, but there is no wall below the surface of the humidification water 16. The humidification water 16 is shared by the first humidification chamber 11 and the second humidification chamber 12. Alternatively, the first humidification chamber 11 and the second humidification chamber 12 may be completely separated with a wall 30, and parts of the chambers under the surface may be connected with a tube. Because the humidification water 16 is shared by the first humidification chamber 11 and the second humidification chamber 12, the level of the humidification water 16 in the first humidification chamber 11 is equal to that in the second humidification chamber 12, and one of the first humidification chamber 11 and the second humidification chamber 12 never runs out of the humidification water 16 earlier than the other. The humidification water 16 is water that can be easily supplied at low cost (for example, tap water). Alternatively, a solution containing, for example, a substance that prevents drying of ink in the recording heads may be used.

The humidification unit 10 is of a hybrid evaporative humidification type. The humidification filters 27*a* and 27*b* are both hollow cylindrical (roller-shaped) rotating bodies made of a material that has a high water absorption rate and is permeable to gas. The lower parts of the humidification filters 27*a* and 27*b* are immersed in the humidification water 16. By rotating the humidification filters 27*a* and 27*b*, the humidification filters 27*a* and 27*b* are soaked entirely. When heated gas is blown to the humidification filters, the gas passes through each humidification filter twice, from the outside to the inside and then from the inside to the outside, thereby being humidified. The gas passes through each of the humidification filters 27*a* and 27*b* twice and therefore passes through the humidification filters 27*a* and 27*b* four times in total. The humidification filters 27*a* and 27*b* rotate in the same direction. The rotation direction is counterclockwise in FIG. 3, that is to say, such a rotation direction that the side of the hollow cylinder of the humidification filter adjacent to the inlet of the humidification chamber (closer to the heater) (the right side) rises from the surface of the humidification water 16, and the side further therefrom (the left side) sinks below the surface. The part of the filter just after emerging from the surface holds a large amount of water, and the amount of water in the part decreases gradually as the filter rotates. Hot gas just after being heated by the heater passes through the part of the filter that holds a larger amount of water (the right side of the filter), and therefore humidification efficiency is high. The first humidification chamber 11 and the second humidification chamber 12 are both humidified with high efficiency, and therefore, overall, extremely high humidification efficiency can be obtained.

By working the fans 23*a* and 23*b* at the same time, outside air is introduced into the first humidification chamber 11 through the inlet 24*a*, and highly humidified gas is blown out through the outlet 28*b*. The rotation speeds of the fans 23*a* and 23*b*, the amounts of heat generation of the heaters 25*a* and 25*b*, and the rotation speeds of the humidification filters 27*a* and 27*b* are variable. By controlling these, the operating output of the humidification unit 10 is varied. By controlling the operating output of the humidification unit 10 on the basis of the detection of the humidity sensor 9, the humidity in the narrow space between the recording unit and the sheet conveying unit can be maintained with a high degree of accuracy.

Figure 4:
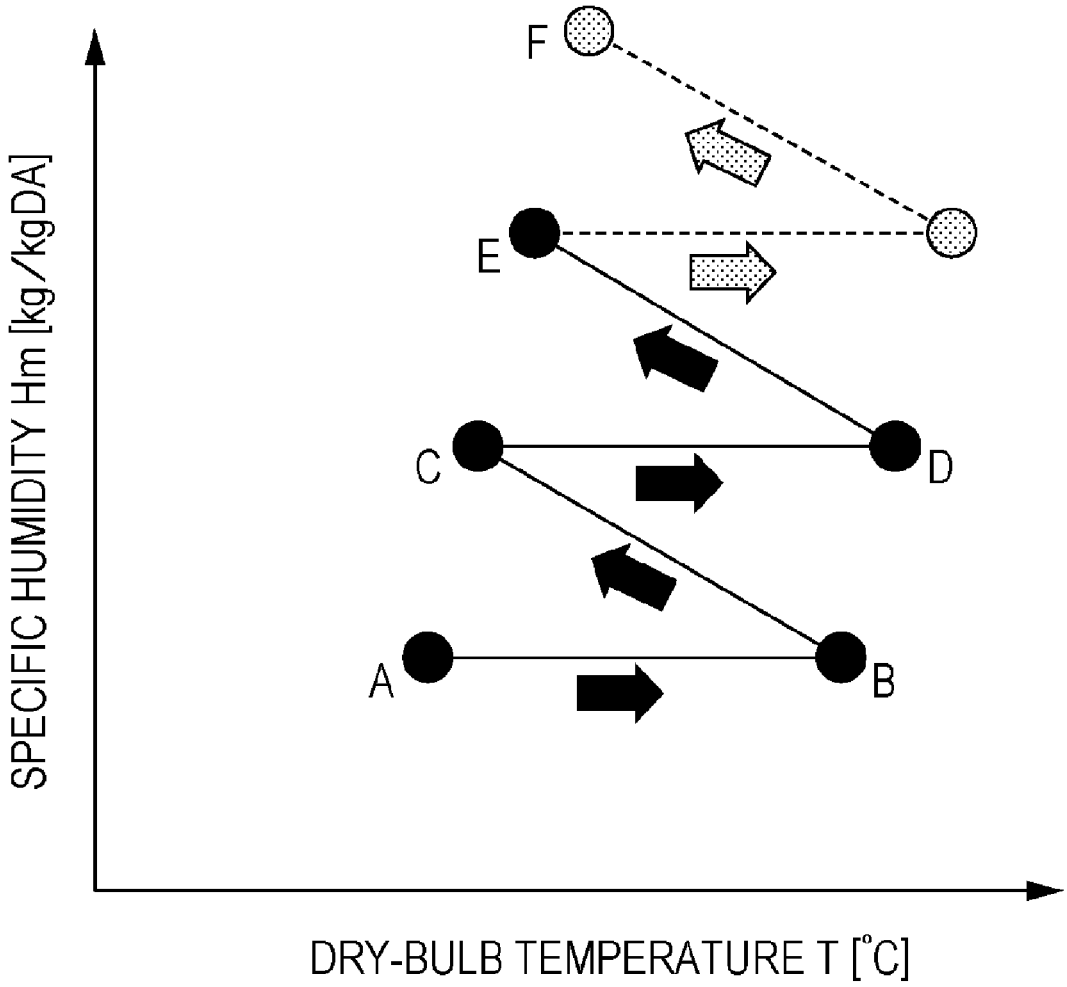
FIG. 4 is a graph showing the change in state of gas during humidification.

FIG. 4 is a graph showing the change in state of gas during humidification with the humidification unit 10. The horizontal axis shows the dry-bulb temperature T [° C.] of humidified gas produced in the humidification unit, and the vertical axis shows the specific humidity Hm [kg/kgDA] (hereinafter referred to as humidity Hm). Outside air introduced through the inlet 24*a* is plotted at point A. In the first humidification chamber 11, the temperature of the introduced gas is raised by the heater 25*a* provided near the inlet 24*a*. At this time, the humidity Hm does not change, and therefore on the graph the state of gas moves from point A to the right, to point B. The gas the temperature of which is raised is blown to the rotating humidification filter 27*a*. A part of the water held by the humidification filter 27*a* vaporizes. The humidity Hm of gas increases, but the temperature of gas decreases due to the vaporization heat. Therefore, the state of gas is plotted at point C on the graph. As described above, the state of gas moves from point A to point C in the first humidification chamber 11. In the movement from point A to point C, the temperature T does not increase so much but the humidity Hm increases.

This humidified gas is introduced into the second humidification chamber 12 and is further humidified in the same manner. The state of gas is moved from point C to point D by the heater 25*b*, and is then moved from point D to point E by the humidification filter 27*b*. Point E is higher in humidity Hm than point C and is much higher in humidity Hm than point A. In the movement from point A to point E, the temperature does not increase so much. The humidified gas is supplied through the outlet 28*b* to the narrow space where the nozzles of the recording heads are exposed. As described above, with a twin humidification device having a first humidification chamber 11 and a second humidification chamber 12 connected in series, the humidity Hm can be raised significantly without raising the dry-bulb temperature T so much, and humidified gas having a high humidity is produced. If three or more similar humidification chambers are connected in series, more highly humidified gas (point F in FIG. 4) can be produced.

The humidified gas supplied to the narrow space in order to prevent drying of the nozzles desirably has a humidity Hm of approximately 0.02019 to approximately 0.02722 [kg/kgDA]. This is equivalent to a humidity of 30° C.·75% to 30° C.·100%.

To produce humidified gas having a humidity in the range described above with a single humidification chamber, a humidification unit larger than the two-chambered humidification unit of this embodiment is required. If equivalent humidified gas is produced with a single humidification chamber, the flow rate of gas passing through the humidification filter needs to be reduced in order to increase vaporization efficiency. Therefore, to ensure a desired flow volume, the passing area of the humidification filter needs to be increased, and as a result, the size of the humidification filter is significantly increased. In this embodiment, the number of times gas passes through the humidification filter can be increased by dividing a humidification chamber into two and connecting them in series. Therefore, the humidification unit of this embodiment is highly efficient and compact because small humidification filters suffice. Therefore, a compact, low-cost, and energy-efficient recording apparatus can be provided.

Chlorinated lime and microscopic dust particles in the humidification water cause clogging of the ink nozzles and therefore should not be introduced into the narrow space. Because the humidification filters 27*a* and 27*b* are of an evaporative type, substances other than water are trapped in water absorbing bodies of the humidification filters and are prevented from spreading into the space. That is to say, evaporative humidification using filters such as that in this embodiment is suitable for moisturizing inkjet recording heads. In other words, by using evaporative humidification, tap water, which contains many unwanted substances but can be supplied at low cost, can be used as humidification water.

Figure 5:
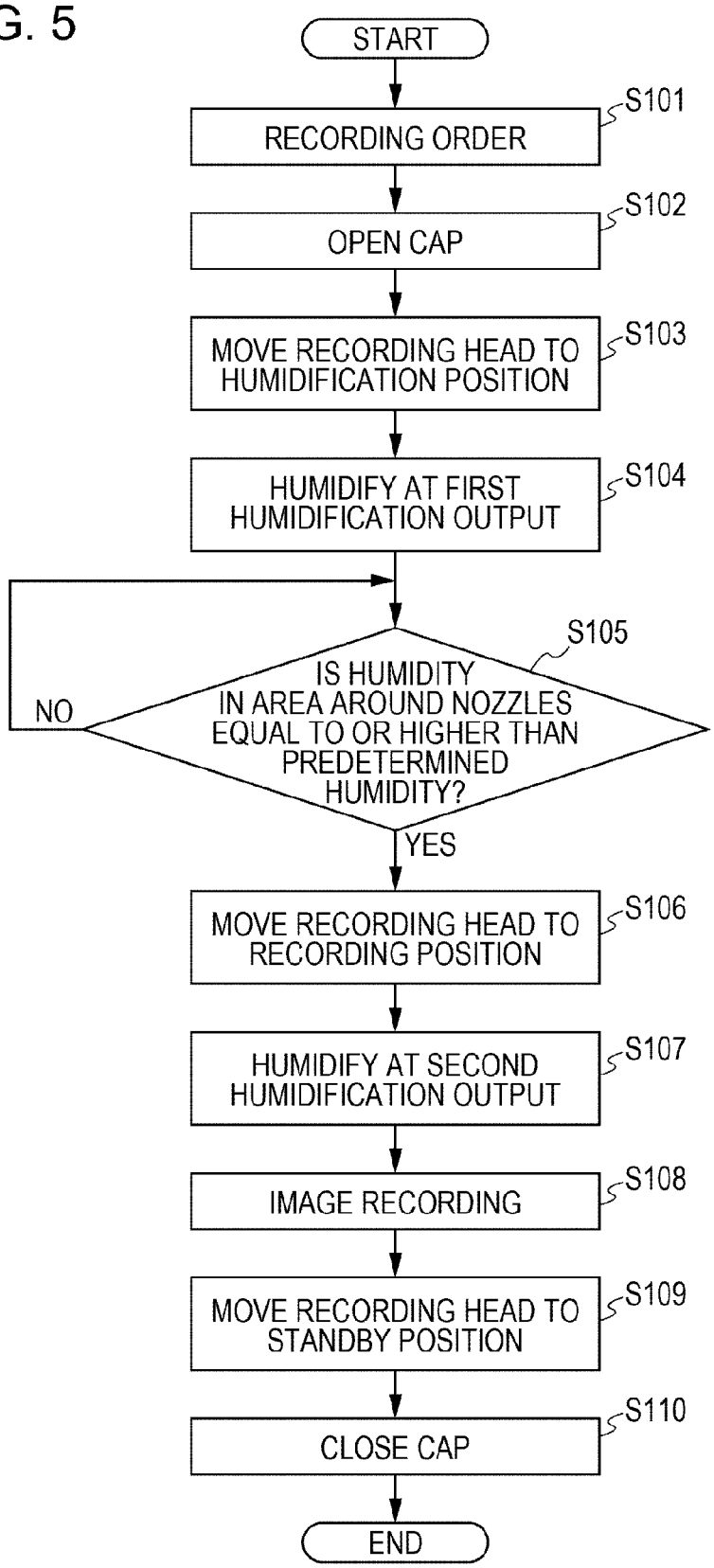
FIG. 5 is a flowchart showing the sequence of operation of the recording apparatus.
Figure 6:
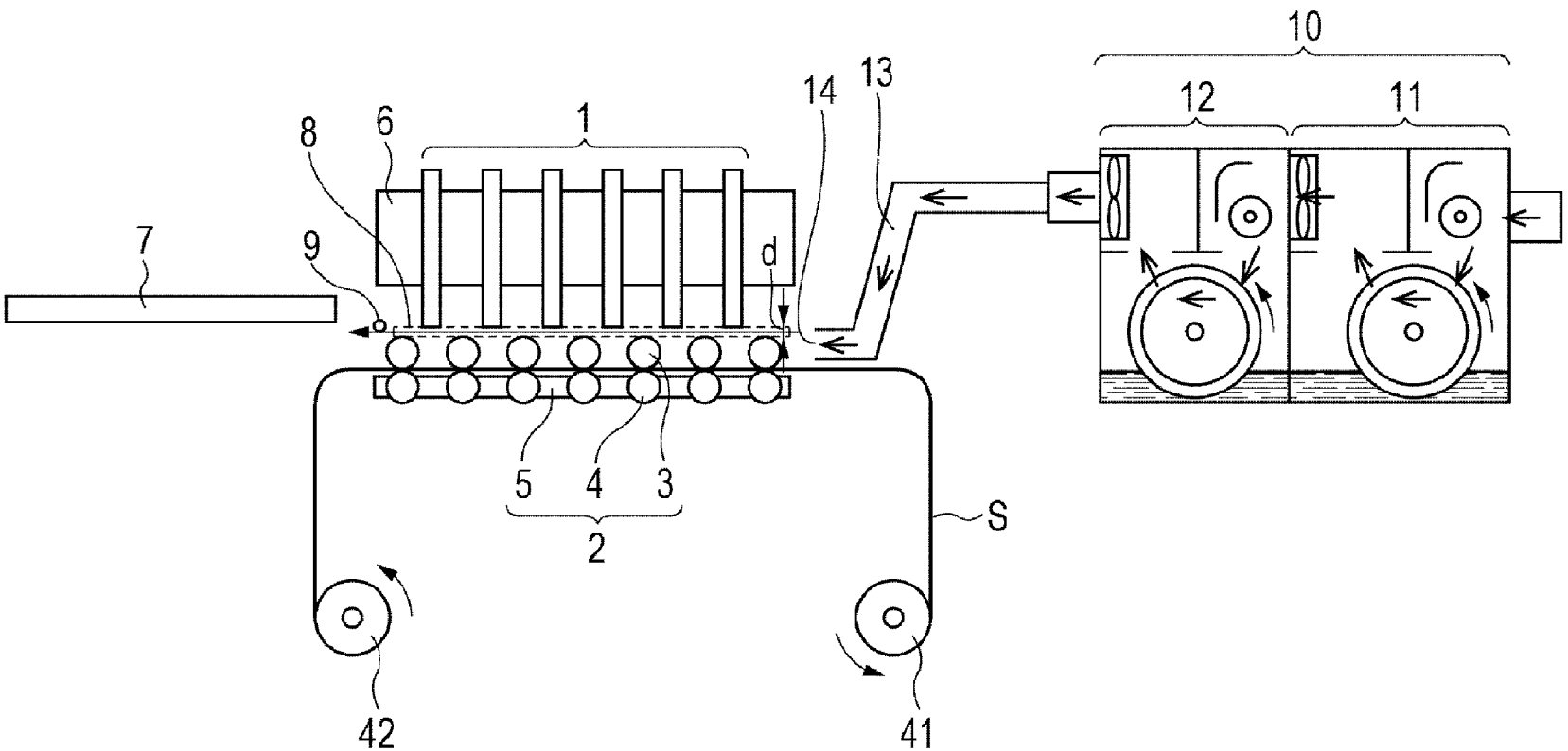
FIG. 6 is a configuration diagram showing the recording apparatus in the state of humidification before recording operation.
Figure 7:
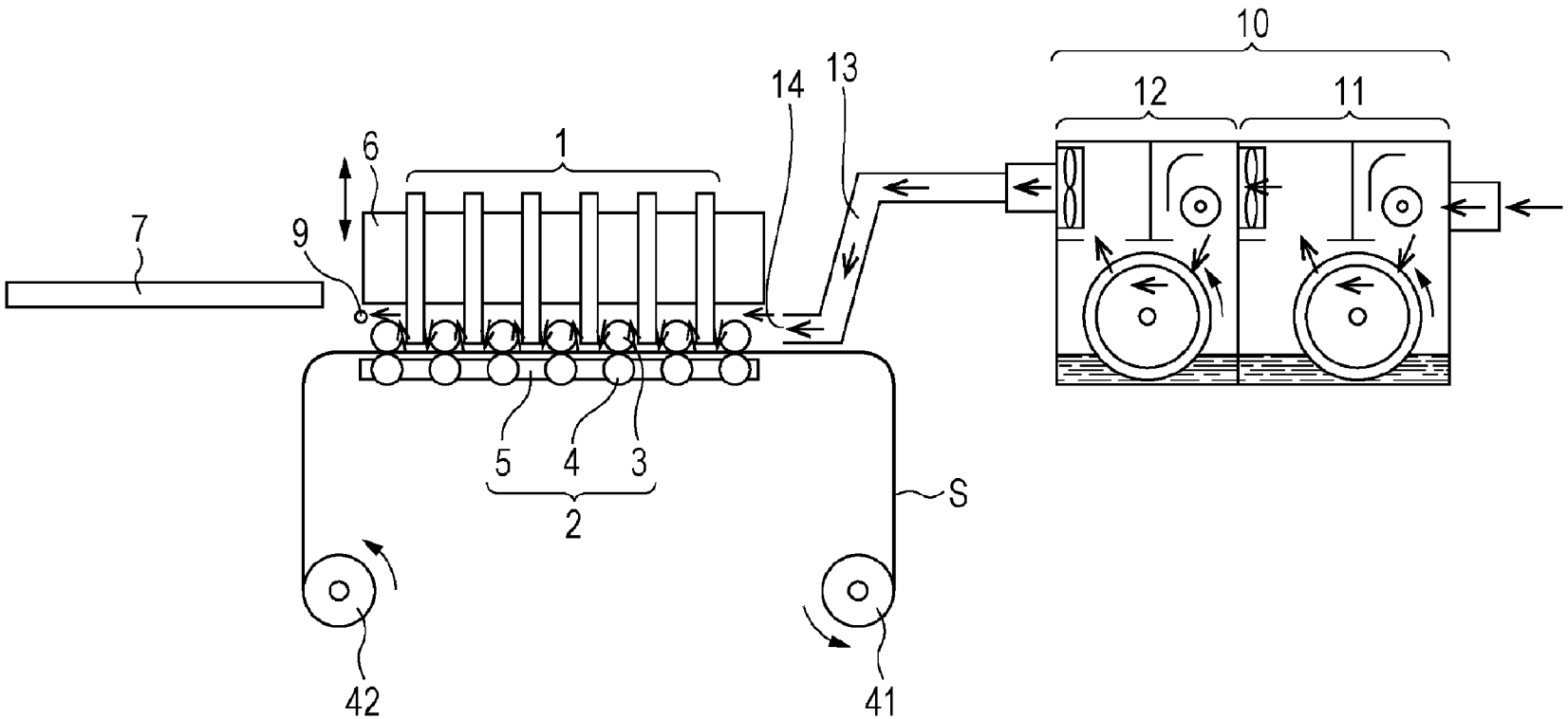
FIG. 7 is a configuration diagram showing the recording apparatus in the state of humidification during recording operation.

The sequence of recording operation in the recording apparatus configured as above will be described. FIG. 5 is a flowchart showing the sequence of operation of the recording apparatus. The following sequence is performed by the control unit 15. FIG. 6 is a configuration diagram showing the state of humidification before recording operation of the recording apparatus (second humidification mode). FIG. 7 is a configuration diagram showing the state of humidification during recording operation of the recording apparatus (first humidification mode).

In the recording apparatus in the standby state, the ink nozzles are covered with the nozzle cap 7 as shown in FIG. 1.

The height position of the head holder 6 in this state is referred to as standby position. In step S101, the recording apparatus receives an order to start recording. In step S102, the nozzle cap 7 is opened and retracted. FIG. 6 shows a state where the nozzle cap 7 is retracted.

In step S103, the adjustment mechanism moves the head holder 6 from the standby position shown in FIG. 1 to a humidification position where a smaller predetermined gap (first gap) is formed.

In step S104, the humidification unit starts humidification, and humidified gas is supplied from the outlet 14. At this time, the humidification output of the humidification unit is maximal (first humidification output), and humidified gas is blown at a large gas volume. The humidification output is adjusted by changing the rotation speed of the humidification filters 27*a* and 27*b* and the rotation speed of the fans 23*a* and 23*b*.

The first gap at the humidification position is desirably larger than the roller diameter of the pinch rollers 3, which all have the same diameter. When this condition is satisfied, as shown in FIG. 6, a straight gas passage 8 with no obstacles is formed along the sheet conveying direction between the top of the plurality of pinch rollers 3 and surfaces of the recording head units 1 in which ink nozzles are formed. Humidified gas supplied to the straight gas passage 8 from the upstream side flows smoothly downstream. A large volume of humidified gas is blown at the maximum output of the humidification unit. Thus, the entire narrow space can be brought into a desired humidified state in a short time.

In step S105, it is determined whether the humidity in the area around the nozzles is equal to or higher than a predetermined humidity on the basis of the detection of the humidity sensor 9, and waiting is performed until the predetermined humidity is reached. If the predetermined humidity is reached, step S106 is proceeded to. According to experiments, the thickness d of the gas passage 8 is desirably 2 mm or more. When d is less than 2 mm, the flow resistance of the gas passage is large, and the time required for the humidity in the area around the nozzles takes to reach the predetermined humidity increases sharply. For example, at the time of start-up of the apparatus, the time from when the supply of humidified gas is started until when the humidity sensor 9 located at the most downstream position detects the predetermined humidity is 10 seconds when d=20 mm, 30 seconds when d=2 mm, 100 seconds when d=0 mm, and 400 seconds when d=−30 mm. With decreasing value of d, the time increases sharply. In particular, when the value of d is negative (in a state where the lower surfaces of the heads are below the tops of the pinch rollers 3), an extremely long time is required. However, increasing the thickness d increases the time required to move the head holder 6 with the adjustment mechanism. The upper limit is desirably 50 mm. In this embodiment, d=20 mm. As described above, the gap between the ink nozzles at the humidification position and the sheet at the recording position (first gap) is at least larger than the roller diameter of the pinch rollers 3. More desirably, the first gap is larger than the roller diameter of the pinch rollers 3 by 2 mm to 50 mm.

In step S106, the adjustment mechanism moves the head holder 6 from the humidification position shown in FIG. 6 to a recording position shown in FIG. 7 where a smaller predetermined gap (second gap) is formed. At the recording position, the lines of nozzles of the recording head units 1 are closer to the sheet S, and a gap suitable for ejecting ink and performing recording is formed. In this embodiment, the second gap is 1 mm. At this position, as shown in FIG. 2, in the sheet conveying direction, the recording head units 1*a* to 1*f* are located between the pinch rollers 3*a* to 3*f*, and the pinch rollers and the recording head units are alternated. In other words, in the sheet conveying direction, a pinch roller 3 is located between adjacent recording head units (first recording head unit and second recording head unit).

In step S107, the output of the humidification unit is changed to a second humidification output smaller than the first humidification output. In step S108, recording is started. During recording, the second humidification output is maintained, and humidified gas continues to be supplied. The humidified gas blown out from the outlet 14 flows through the narrow space 50 while meandering up and down as shown by arrows in FIG. 7. Therefore, it takes a long time for the entire narrow space 50 from the most upstream part to the most downstream part to reach the predetermined humidity. However, because the narrow space 50 is brought to the predetermined humidity in advance in steps S102 to S105, the humidity in the narrow space can be maintained with a minimum supply of humidified gas. During recording operation, by operating at the second humidification output smaller than the first humidification output, power consumption as well as the consumption of water accumulated in the humidification unit 10 can be reduced. If the wind speed in the area around the ink nozzles is too high during recording, the flight of ink ejected from the nozzles is affected and the landing accuracy is deteriorated. For the purpose of preventing deterioration of the landing accuracy, it is effective to reduce the output of the humidification unit and to reduce the flow rate of the humidified gas during recording.

After recording to be performed is completed in step S108, step S109 is proceeded to. In step S109, the adjustment mechanism returns the head holder 6 from the recording position to the standby position shown in FIG. 1. The nozzle cap 7 is moved to the capping position under the recording unit, and the ink nozzles are covered. Thus, the sequence is completed.

This embodiment can produce humidified gas having a desired high humidity with a compact and highly efficient humidification unit. By humidifying inkjet recording heads with this humidified gas, a highly reliable recording apparatus can be provided. The recording apparatus of this embodiment holds a sheet firmly with a plurality of roller pairs. Therefore, even a sheet having a high stiffness and strongly curled can be flattened, and high-quality recording can be performed on various types of sheets. In addition, an environment that appropriately moisturizes recording heads can be made in a short time, and therefore a recording apparatus that can be started up in a short time can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-106714 filed May 6, 2010, which is hereby incorporated by reference herein in its entirety.

What is claimed is:

1. An apparatus comprising:

a recording unit including an inkjet recording head unit; and a humidification unit for supplying humidified gas into a space where nozzles of the recording head unit are exposed, wherein the humidification unit has a first humidification chamber for producing humidified gas and a second humidification chamber connected to the first humidification chamber, humidified gas produced in the first humidification chamber is introduced into the second humidification chamber, further humidified gas is produced in the second humidification chamber, and the further humidified gas is supplied from the second humidification chamber to the space.

2. The apparatus according to claim 1, wherein the first humidification chamber and the second humidification chamber are separated by a wall and are adjacent to each other in a case, and wherein at the bottom of the first humidification chamber and the second humidification chamber, humidification water for humidification shared by the first humidification chamber and the second humidification chamber is accumulated.

3. The apparatus according to claim 2, wherein:

the first humidification chamber and the second humidification chamber each have a heater, a humidification filter, and a fan, and gas introduced through an inlet provided in the case is:

heated by the heater in the first humidification chamber, humidified by the humidification filter, sent to the second humidification chamber by the fan, then heated by the heater in the second humidification chamber, further humidified by the humidification filter, and supplied by the fan through an outlet provided in the case to the space where nozzles of the recording head unit are exposed.

4. The apparatus according to claim 3, wherein:

the humidification filters provided in the first humidification chamber and the second humidification chamber each have a hollow cylindrical rotating body made of a material that has a high water absorption rate and is permeable to gas, the rotating body rotates with a part thereof immersed in the humidification water, and gas heated by the heater and blown to the humidification filter passes through the humidification filter from the outside to the inside and then from the inside to the outside.

5. The apparatus according to claim 4, wherein in each of the first humidification chamber and the second humidification chamber, the rotating body rotates in such a direction that a side closer to the heater rises from a surface of the humidification water and a side further from the heater sinks below the surface of the humidification water.

6. The apparatus according to claim 4, wherein an operating output of the humidification unit is adjusted by changing amounts of heat generation of the heaters and rotation speeds of the humidification filters.

7. The apparatus according to claim 1, wherein the humidified gas supplied to the space has a specific humidity of approximately 0.02019 to approximately 0.02722 [kg/kgDA].

8. The apparatus according to claim 1, wherein the recording unit includes a first recording head unit and a second recording head unit arranged in a direction in which a sheet is conveyed and each having ink nozzles, and wherein the humidification unit is for supplying humidified gas to the space where the ink nozzles of each of the first recording head unit and the second recording head unit are exposed.

9. The apparatus according to claim 8, further comprising:

a sheet conveying unit having a pair of rollers including a first roller and a second roller, the pair of rollers nipping the sheet at least between a recording location of the first recording head unit and a recording location of the second recording head unit and in which the first roller is located between the first recording head unit and the second recording head unit at least when recording;

an adjustment mechanism for varying a gap between the ink nozzles and the sheet; and a control unit that performs control such that prior to recording, the humidification unit supplies the humidified gas to the gap at a first gap, the adjustment mechanism then varies the gap to a second gap smaller than the first gap, and then the recording unit starts recording on the sheet.

10. The apparatus according to claim 9, wherein when humidified gas is supplied at the first gap, the control unit performs control such that the output of the humidification unit is larger than that when humidified gas is supplied at the second gap.

11. The apparatus according to claim 9, further comprising a humidity sensor that detects the humidity of gas near the second recording head, and wherein, based on a detection of the humidity sensor, the control unit performs control such that the gap is changed from the first gap to the second gap.

12. A device that produces humidified gas, the device comprising:

a first humidification chamber for producing humidified gas; and a second humidification chamber connected to the first humidification chamber, wherein humidified gas produced in the first humidification chamber is introduced into the second humidification chamber, further humidified gas is produced in the second humidification chamber, and the further humidified gas is supplied from the second humidification chamber to the space.

13. The device according to claim 12, wherein the device supplies humidified gas into a space where nozzles of a recording head unit are exposed.

14. The device according to claim 13, wherein the first humidification chamber and the second humidification chamber are separated by a wall and are adjacent to each other in a case, and wherein at the bottom of the first humidification chamber and the second humidification chamber, humidification water for humidification shared by the first humidification chamber and the second humidification chamber is accumulated.

15. The device according to claim 14, wherein:

the first humidification chamber and the second humidification chamber each have a heater, a humidification filter, and a fan, and gas introduced through an inlet provided in the case is:

heated by the heater in the first humidification chamber, humidified by the humidification filter, sent to the second humidification chamber by the fan, then heated by the heater in the second humidification chamber, further humidified by the humidification filter, and supplied by the fan through an outlet provided in the case to the space where nozzles of the recording head unit are exposed.

16. The device according to claim 15, wherein:

the humidification filters provided in the first humidification chamber and the second humidification chamber each have a hollow cylindrical rotating body made of a material that has a high water absorption rate and is permeable to gas, the rotating body rotates with a part thereof immersed in the humidification water, and gas heated by the heater and blown to the humidification filter passes through the humidification filter from the outside to the inside and then from the inside to the outside.

17. The device according to claim 16, wherein in each of the first humidification chamber and the second humidification chamber, the rotating body rotates in such a direction that a side closer to the heater rises from a surface of the humidification water and a side further from the heater sinks below the surface of the humidification water.

18. The device according to claim 16, wherein an operating output of the humidification unit is adjusted by changing amounts of heat generation of the heaters and rotation speeds of the humidification filters.

19. The device according to claim 12, wherein the humidified gas supplied to the space has a specific humidity of approximately 0.02019 to approximately 0.02722 [kg/kgDA].

* * * * *